United States Patent [19]

Wilkinson

[11] Patent Number: 5,052,556

[45] Date of Patent: Oct. 1, 1991

[54] TOOTHBRUSH TRAVELING CASE

[76] Inventor: William T. Wilkinson, Box 378, Chesapeake City, Md. 21915

[21] Appl. No.: 588,352

[22] Filed: Sep. 26, 1990

[51] Int. Cl.[5] ..... B65D 83/10

[52] U.S. Cl. ..... 206/362.2; 206/15.2; 206/15.3; 206/362.3; 15/184; 132/308

[58] Field of Search ..... 206/361, 361.2, 362.2, 206/362.3, 15.2, 15.3; 15/184, 185; 132/308, 310

[56] References Cited

U.S. PATENT DOCUMENTS

| | | | |
|---|---|---|---|
| 615,357 | 12/1898 | Johnson et al. | 206/362.3 |
| 634,906 | 10/1899 | McCloskey | 206/362.3 |
| 1,205,311 | 11/1916 | Wybaillie | 206/362.1 |
| 1,303,884 | 5/1919 | Goodnow | 206/362.1 |
| 1,959,600 | 5/1934 | Schneider et al. | 132/310 |
| 2,304,227 | 12/1942 | Zafarana | 206/362.2 |
| 2,471,979 | 5/1949 | Rozzi et al. | 206/362.1 |
| 2,642,331 | 6/1953 | Sprinkle | 206/362.1 |
| 2,719,626 | 10/1955 | Lermer | 206/362.2 |
| 2,937,910 | 5/1960 | Randa | 206/362.3 |
| 3,002,798 | 10/1961 | Corley | 132/308 |
| 3,325,847 | 6/1967 | Meranto | 206/362.3 |
| 4,884,311 | 12/1989 | Gergory | 206/362.2 |

*Primary Examiner*—David T. Fidei
*Attorney, Agent, or Firm*—Charles S. Knothe

[57] ABSTRACT

A travel case for a tooth brush having a various shaped cases, rigidly attached to the case is a brush handle clip, the brush handle clip consisting of two opposing semi-rigid jaws with the entry side of each jaw rounded creating a narrow catch which opens to an open cavity, a bumper affixed to the case such that the bumper keeps the tooth brush from contacting the case in two directions, one surface of the bumper has a concave shape and the bumper is aligned with the centerline of the two jaws of the clip.

7 Claims, 4 Drawing Sheets

TOOTHBRUSH TRAVELING CASE

BACKGROUND OF INVENTION

The traveler today is faced with the dilemma of taking his tooth brush which is necessary for modern oral dental hygiene along with him on his journeys yet keeping it clean and sanitary so that it does not accumulate dirt, filth and bacteria. This contamination can come from other items that are packed with the tooth brush, or from placing the tooth on a contaminated surface before or after use. Current medical research indicates the tooth brush is a major contributor to the spread of colds and sickness, yet the tooth brush is a necessary tool in the preservation of teeth and gums.

An object of this invention is a travel case for a tooth brush to guard the bristles and the upper tooth brush handle from coming in contact with the case and becoming contaminated. Another object of this invention is to accommodate various size brushes and various size brush handles and handle shapes.

SUMMARY OF INVENTION

A travel guard for a tooth brush is made from various shaped cases. Rigidly attached to the case is a tooth brush handle clip. The tooth brush handle clip consists of two opposing semi-rigid jaws with the entry side of each jaw rounded, creating a narrow catch which opens to an open cavity such that as the tooth brush handle is inserted between the jaws, the jaws spread and when the brush handle is seated in the cavity the jaws close. A bumper affixed to the case such that the bumper keeps the tooth brush from contacting the case in two directions, one surface of the bumper has a concave shape and the bumper is aligned with the center line of two jaws.

DETAILED DESCRIPTION OF THE DRAWINGS

Figure 1:
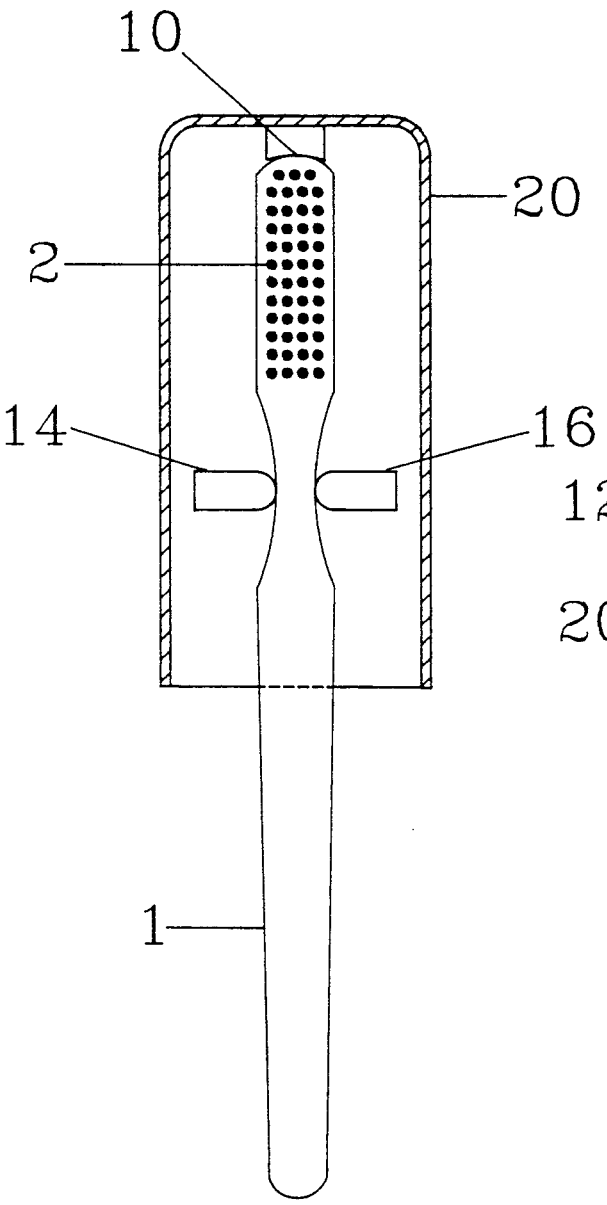
FIG. 1 is front view in cross section of the device with an intermediate length case.

In FIG. 1 the upper portion of the tooth brush 1 is covered by intermediate length case 20. The tooth brush 1 is located between the tooth brush handle clip left jaw 14 and the tooth brush handle clip right jaw 16. The handle of the tooth brush snap fits between these two jaws. The top of the brush 1 contacts the bumper 10 such that the brush is firmly positioned within the case 20. The face of the bumper 10 has a slight concave surface so that the top of the brush remained centered on the bumper face. Therefore the bristles 2 of the tooth brush 1 do not come in contact with the case 20 keeping the bristles free of contamination. The brush is inserted in the case through the aperture in the bottom of the case 20.

Figure 2:
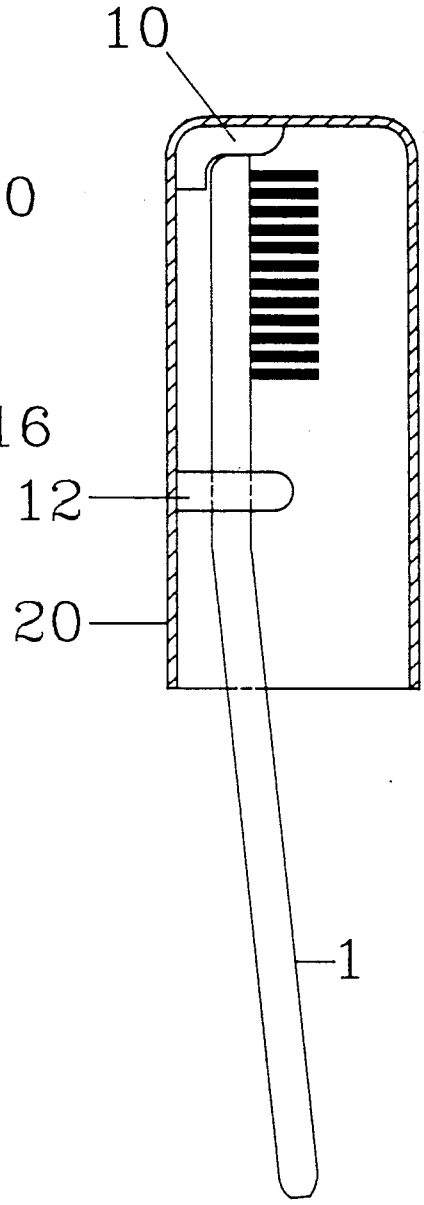
FIG. 2 is a side view in cross section of the device with an intermediate length case.

Some tooth brush handles are bent so that the back teeth of the brusher can be reached easier. FIG. 2 shows a tooth brush 1 with such a handle. This figure also shows the bumper 10 which has an "L" shape. This shape keeps the brush from contacting both the back and top of the case.

Figure 3:
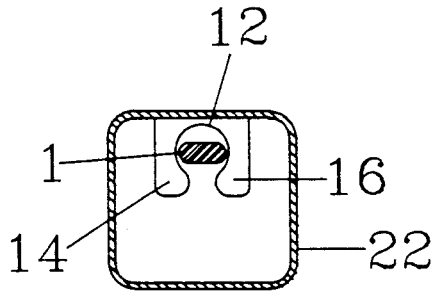
FIG. 3 is top view in cross section showing the tooth brush handle clip.

The tooth brush handle clip 12 is shown in FIG. 3 This clip consists of two jaws, the left jaw 14 and the right jaw 16. These jaws are shaped such that they have a wide opening at the beginning of the entry way and narrow to a smaller opening and then enlarge to an open cavity wherein the brush handle 1 is lodged for keeping. The jaws are of elastic material and flex to allow entry of the handle and to securely grip the tooth brush handle once the handle is inserted in the clip.

Figure 4:
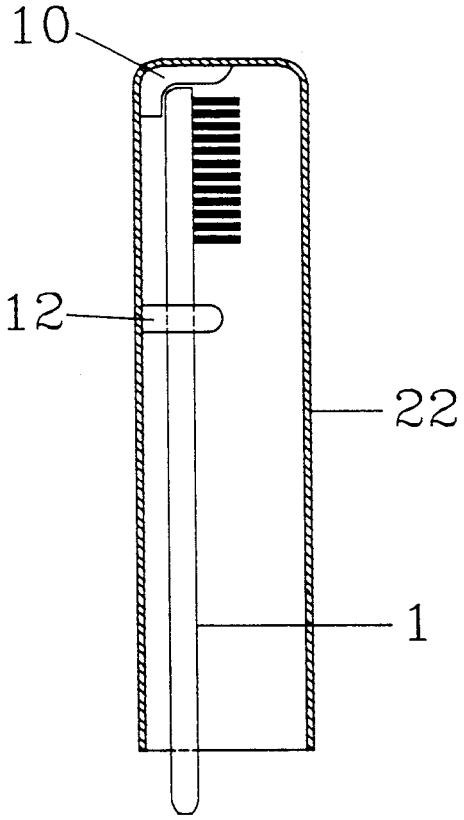
FIG. 4 is a side view in cross section of the device with a full length case.
Figure 5:
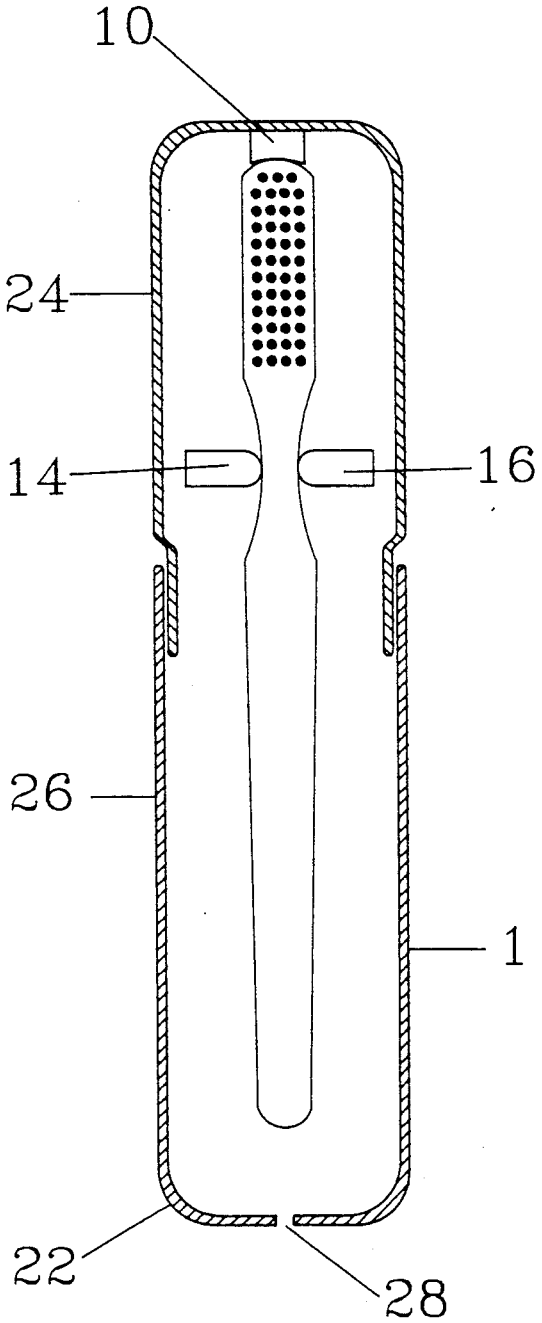
FIG. 5 is a front view in cross section of the device with full length casing with separating upper and lower receptacles.

FIG. 4 shows a full length case 22. The longer length of the case protects the tooth brush bristle from contamination. FIG. 5 shows a case 22 which consists of an upper receptacle 24 and a lower receptacle 26. The two receptacles slide fit or snap fit together to keep the tooth brush clean. The vent aperture 28 allows the moisture to evaporate.

Figure 6:
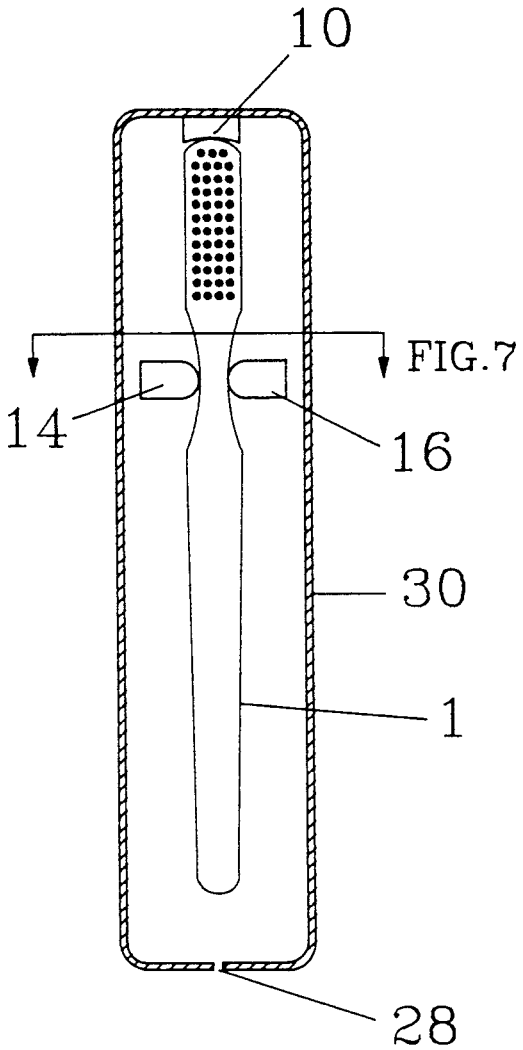
FIG. 6 is a front view in cross section of the case with a hinged cover.
Figure 7:
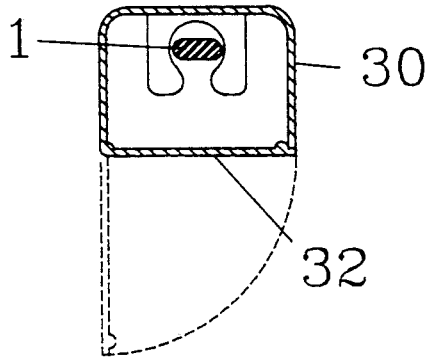
FIG. 7 is a cross sectional view along line 7 of FIG. 6 of a case with a hinged cover.
Figure 10:
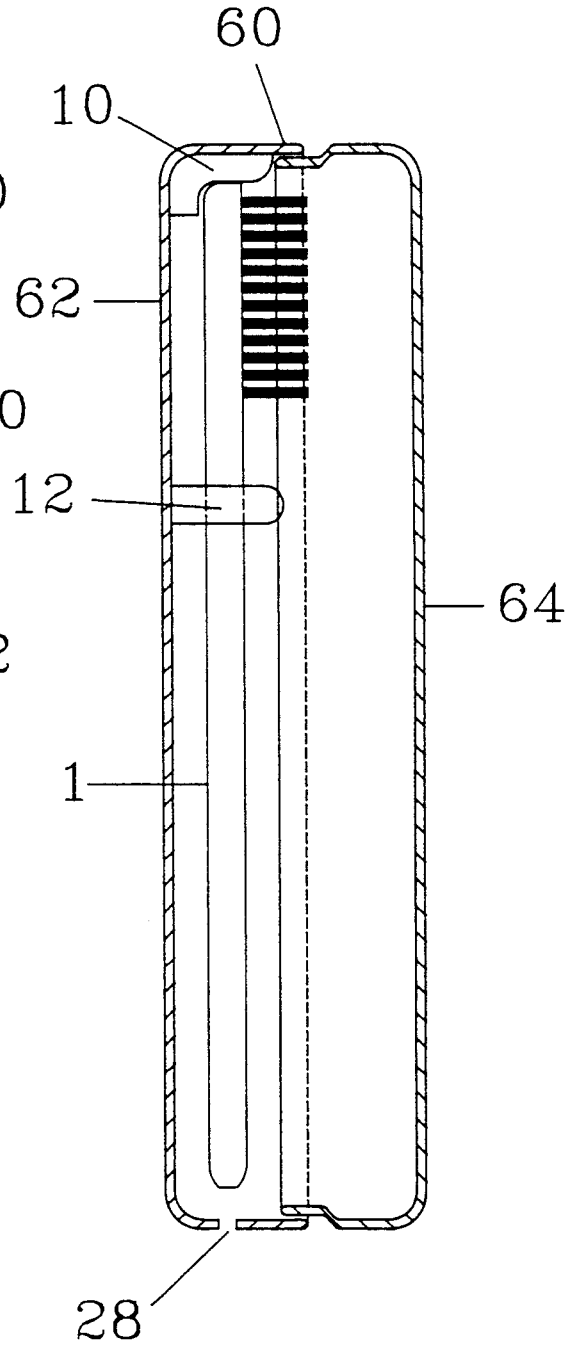
FIG. 10 is a side view in cross section of the device with a full length case with separating bottom and upper receptacles.

FIG. 6 and 7 show a case 30 with a hinged door 32. The door slide fits or snaps fits to the case wall. A similar embodiment is FIG. 10 which shows a case 60 with a bottom receptacle 62 and an upper receptacle 64. The two receptacles either slide fit or snap fit together. These embodiments of the invention provide complete protection of the tooth brush with the ease of full access to insert and remove the brush in the case.

Figure 8:
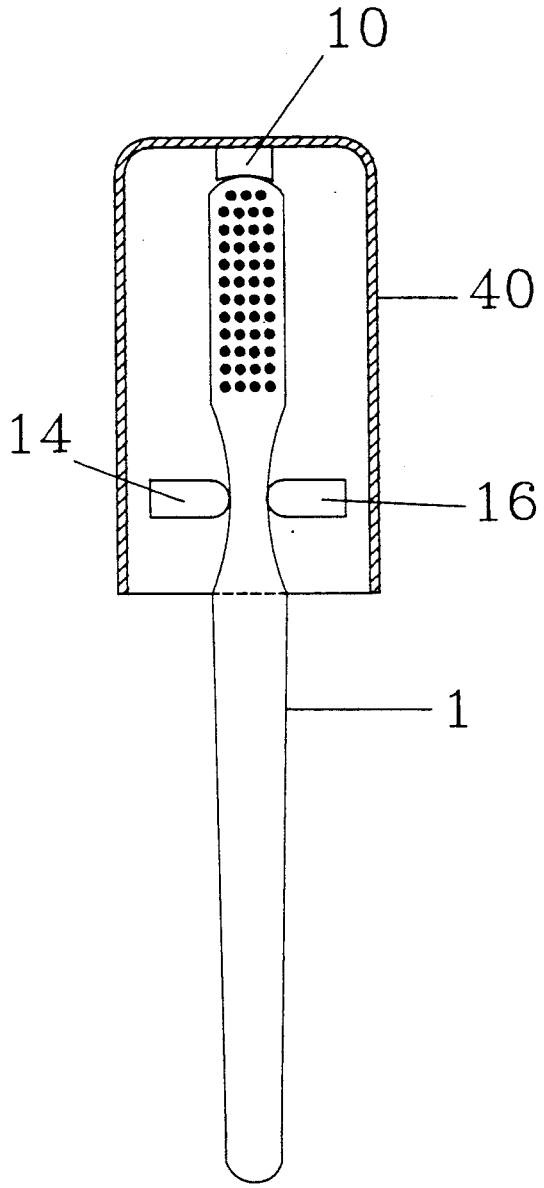
FIG. 8 is front view in cross section of the device with a short length case.
Figure 9:
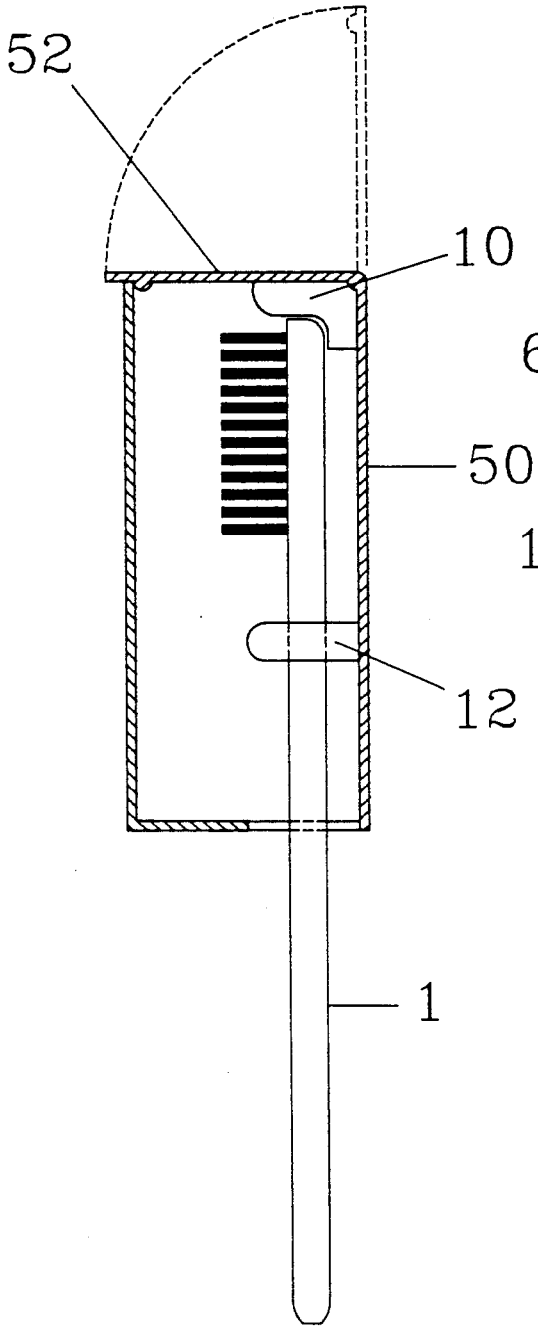
FIG. 9 is a side view in cross section of the device with a hinged top.

In FIG. 8 the case is of short length only covering the top portion of the tooth brush. The brush 1 is positioned between the left jaw 14 and the right jaw 16 and the bumper 10. FIG. 9 shows an alternate embodiment of the short length case wherein the case 50 has an aperture in the bottom of the case for the brush handle 1 to protrude and a hinged top 52.

I claim:

1. I claim a travel case for a tooth brush comprising:

a case;

a tooth brush handle clip rigidly affixed to the case;

the tooth brush handle clip consists of two opposing semi-rigid jaws with the entry side of each jaw rounded, creating a narrow catch which opens to an open cavity such that as the tooth brush handle is inserted between the jaws the jaws spread and when the brush handle is seated in the cavity the jaws close;

a bumper affixed to the case such that the bumper keeps the tooth brush from contacting the case in two directions, one surface of the bumper has a concave shape and the bumper is aligned with the center line of two jaws.

2. The same device as in claim 1 wherein the case has four walls which have sufficient length to shroud the tooth brush bristles and a top such that entry of the toothbrush is by inserting it through the aperture formed by the four walls.

3. The same device as in claim 1 wherein the case has four walls which have sufficient length to shroud the tooth brush bristles and part of the tooth brush handle and a top such that entry of the tooth brush is by inserting it through the aperture formed by the four walls.

4. The same device as in claim 1 wherein the case has four walls which have sufficient length to shroud the tooth brush bristles and the entire handle of the tooth brush and a top such that entry of the tooth brush is by inserting it through the aperture formed by the four walls.

5. The same device as in claim 1 wherein the case has an upper receptacle with a cup like shape with one end open, side perimeter walls and a top wall with the tooth brush handle clip affixed to one of the perimeter walls and the bumper affixed to the top wall and a lower receptacle in a cup like shape with one end open, side perimeter walls and a bottom, the bottom contains a small vent aperture, the open end of the lower receptacle removably interacts with the open end of the upper receptacles.

6. The same device as in claim 1 wherein the case has perimeter walls, a bottom and a hinged top which covers the entire length of the tooth brush; the hinge is affixed along the length of the perimeter wall.

7. The same device as in claim 1 wherein the case has perimeter walls with the tooth brush handle clip and the bumper affixed to one of the perimeter walls, the bottom with an aperture for the handle of the tooth brush to protrude and a hinged top.

* * * * *